US005186364A

United States Patent [19]

Laszlo

[11] Patent Number: 5,186,364

[45] Date of Patent: Feb. 16, 1993

[54] DISPENSING HEAD FOR APPLYING FOAMY PRODUCT ON A SKIN SURFACE

[76] Inventor: Telekesi Laszlo, 1875 Martin Grove Rd. Apt. 307, Rexdale, Ontario, Canada, M9V 3S8

[21] Appl. No.: 731,133

[22] Filed: Jul. 15, 1991

[30] Foreign Application Priority Data

Nov. 20, 1990 [CA] Canada ..... 2030297

[51] Int. Cl.[5] ..... B65D 83/28

[52] U.S. Cl. ..... 222/153; 222/402.11; 222/402.13; 401/190

[58] Field of Search ..... 239/337, 499; 222/402.13, 402.15, 402.11, 402.21, 575, 566, 570, 402.1, 394, 153; 401/190

[56] References Cited

U.S. PATENT DOCUMENTS

| | | | |
|---|---|---|---|
| 3,093,857 | 6/1963 | Hersh | 401/190 |
| 3,185,349 | 5/1965 | Sagarin | 222/402.11 |
| 3,351,418 | 11/1967 | Karnuth | 401/190 |
| 3,387,911 | 6/1968 | Focht | 401/190 |
| 3,642,179 | 2/1972 | Micallef | 222/402.11 |
| 3,685,913 | 8/1972 | Pass | 401/190 |
| 4,752,020 | 6/1988 | Grueter et al. | 222/402.11 |
| 4,848,946 | 7/1989 | Goncalves | 401/190 |

FOREIGN PATENT DOCUMENTS

| | | | |
|---|---|---|---|
| 978912 | 12/1975 | Canada . | |
| 1002012 | 12/1976 | Canada . | |
| 2184789 | 7/1987 | United Kingdom | 401/190 |

*Primary Examiner*—Kevin P. Shaver
*Assistant Examiner*—Karen B. Merritt

[57] ABSTRACT

A foam dispensing head for use with a pressurized container comprising an actuator member for discharging a foam producing substance from the container and an elastically squeezable bowl member for collecting the discharged substance and applying it on a skin surface. The bowl member has a continuous wall enclosing a collecting chamber, an inlet end attachable to the actuator member, and a terminal end having at least one exit opening therethrough. Lightly pressing the terminal end of the dispensing head against the skin surface causes the bowl member to squeeze, whereby the product is forced out from the collecting chamber through the exit opening and is deposited directly onto the skin surface.

7 Claims, 3 Drawing Sheets

DISPENSING HEAD FOR APPLYING FOAMY PRODUCT ON A SKIN SURFACE

FIELD OF THE INVENTION

This invention relates to pressurized aerosol or other relatively small, hand-held dispensers, and more particularly to the dispensing heads for such dispensers.

In the past, discharging foamy or creamy product from a pressurized container and applying the discharged product on a skin surface has required the use of two hands. One hand has been required to hold the container and operate its valve, and the other one to collect the discharged product and apply it on the skin surface.

Dispenser caps for collecting foam-producing pressurized substance from a pressurized container are known. For instance, Canadian Patent Nos. 978,912 and 1,002,012 disclose dispenser caps having recessed, expansive transverse top walls. However, the operation of these kind of caps has still required the use of two hands. Furthermore, like other prior dispenser actuators, the product was applied on the skin surface from the user's palm. This prior procedure was inconvenient and always resulted in a high wastage of the product.

Objects of the present invention include: providing a dispensing head and a method for using it to discharge and collect foam-producing pressurized substance from a pressurized container and to apply the discharged product on a skin surface, providing such a head which can be operated single-handedly and conveniently, providing a dispensing head which reduces wastage of the product and providing a dispensing head having the above features and which is easy to manufacture.

According to the present invention there is provided for use with a pressurized container including a centrally located valve having an orificed valving member, a dispensing head comprising: (a) an actuator member having a ring portion for attachment to said container at a position radially spaced from and surrounding a vertical axis defined by said valving member, a generally circular outlet wall portion hingedly connected to said ring portion at a first radial position and defining an outer pressing surface at its upper side, said outer pressing surface having a normal axis, said actuator member further having a discharge orifice opening through said outer pressing surface, valving member engaging means, a finger tab portion connected to said outlet wall portion substantially opposite to said first radial position, and disabling means being operable between a first locked and a second unlocked position; and (b) an elastically squeezable bowl member attached to said outlet wall portion of said actuator member, said bowl member having generally tubular continuous wall means enclosing a collecting chamber therein, said wall means defining a central axis generally uniaxial with said normal axis, the upper end of said wall means defining a terminal end surface, said terminal end surface having at least one exit opening therethrough in communication with said collecting chamber, the lower end of said wall means defining an inlet end surface attached to said outer pressing surface, said inlet end surface having an inlet opening therethrough aligned with said discharge orifice and being in communication with said collecting chamber.

Also according to the present invention there is provided a foam dispensing head for use with a pressurized container having an outlet valve, said dispensing head comprising: (a) a mounting member for mounting said dispensing head to said container over said outlet valve; (b) a valve actuator mounted to said mounting member and connectable to said outlet valve to actuate said valve to discharge product from said container; and (c) a collector for collecting said discharged product, said collector having a generally continuous resiliently collapsible wall, one end of said wall mounted to said mounting member and the opposite end of said wall defining a terminal end; in use, pressing of said terminal end against a surface causes said wall of said collector to resiliently collapse thereby allowing product to escape past said terminal end to be deposited on said surface.

Further, the present invention includes an improved method for applying foamy product on a skin surface from a pressurized container having a product discharging valve, said method comprising:

- equipping said pressurized container with a dispensing head having an elastically squeezable bowl, said bowl defining a product collecting chamber and a terminal end surface having at least one exit opening therethrough in communication with said collecting chamber;
- operating said valve to discharge said product from said pressurized container into said collecting chamber;
- abutting said terminal end surface of said bowl on the skin surface;
- lightly pressing said pressurized container toward said skin surface substantially normal thereto to squeeze said bowl, whereby the product is forced out from said collecting chamber through said exit opening and is deposited directly onto the skin surface; and
- moving said pressurized container sideways while pressing said terminal end surface of said bowl toward the skin surface to spread the product evenly thereon.

In the drawings which illustrate embodiments of the invention:

Figure 1:
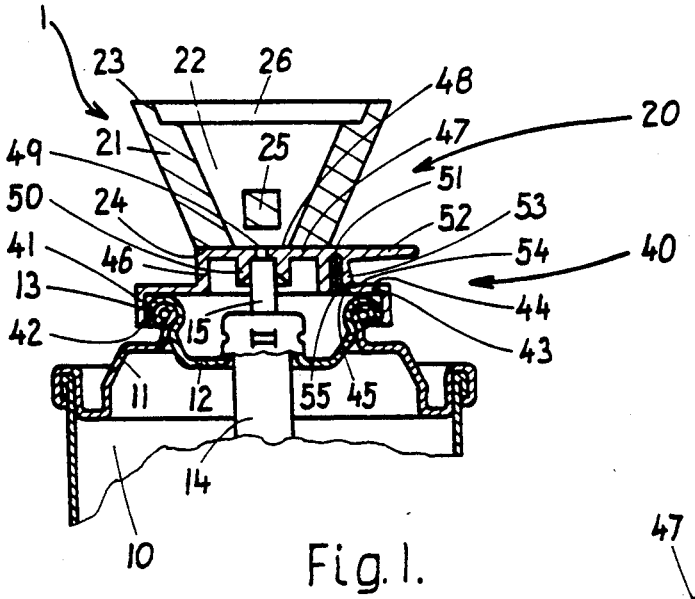
FIG. 1 is an axial sectional view of the upper portion of a pressurized container having a dispensing head embodied in the present invention.

With reference now to FIG. 1, there is shown a dispensing head 1 in accordance with the present invention, which is designed for utilization with a conventional pressurized container 10. Container 10 is a cylindrical container having a circular closure wall 11 to which a valve carrying cap 12 is attached by curling outward and downward its rim 13. The cap 12 carries a conventional reciprocable valve assembly 14 having a preloaded compression closing spring (not shown) which bears upward against a tubular outlet stem 15. The product from the container 10 is discharged through the outlet stem 15 when it is pressed downward.

In this embodiment, the dispensing head 1 consists of an actuator member generally designated 40 and a bowl member generally designated 20. The actuator member 40 is a molded plastic part, preferably circular in plan form. The bowl member 20 is made of flexible synthetic foam which can be easily squeezed by a light manual operation. The bowl member 20 is also preferably circular in plan form.

Figure 2:
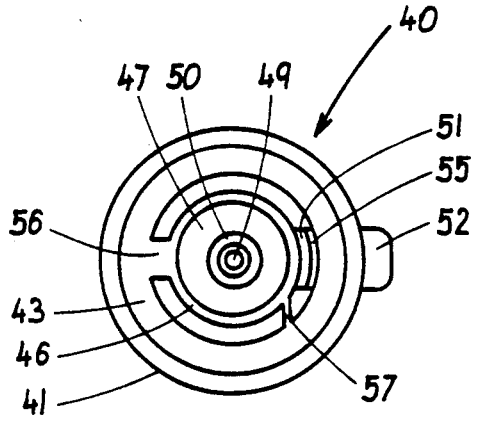
FIG. 2 is a bottom plan view of the actuator member of the dispensing head of FIG. 1.

The actuator member 40 has a ring portion 41 which is attached to container 10 at a position radially spaced from and surrounding the axis defined by the outlet stem 15. The ring portion 41 has an undercut 42 and a flange 43 for securely engaging the rim 13 of container 10. Flange 43 defines an upper surface 44 and an inner surface 45. The actuator member 40 also has a horizontal circular outlet wall portion 47. A rigid annular wall 46 is joined to and extending downward from the periphery of said outlet wall portion 47. The wall 46 is connected to the flange 43 by a first hinge 56 and by a fragible web 57, as shown in FIG. 2. Web 57 secures the dispensing head 1 against operable engagement with the pressurized container 10 until it is broken by an ultimate user.

Referring to FIG. 1, the outlet wall portion 47 defines an outer pressing surface 48 at its upper side and a centrally located discharge orifice 49 opening therethrough. The outer pressing surface 48 has a normal axis which is uniaxial with the axis defined by the outlet stem 15. The outlet wall portion 47 is provided with a nipple 50 which mates with stem 15 and leads to to the discharge orifice 49.

A finger tab portion 52 is connected to the outlet wall portion 47 by a second hinge 51 at a radially opposite position to the first hinge 56. A locking tang 53 is rigidly joined to the underside of the finger tab portion 52. The locking tang 53 has an overlapping surface 54 at its lower end which is shown in FIG. 1 as abutting the upper surface 44 of the flange 43. This arrangement corresponds to the actuator member 40 being in a first locked position with the locking tang 53 blocking depression of the outlet wall portion 47. The locking tang 53 also has a projection 55 for overlapping the inner surface 45 of the flange 43 to prevent the tang 53 from swinging out when a force is applied to the outer pressing surface 48.

Figure 4:
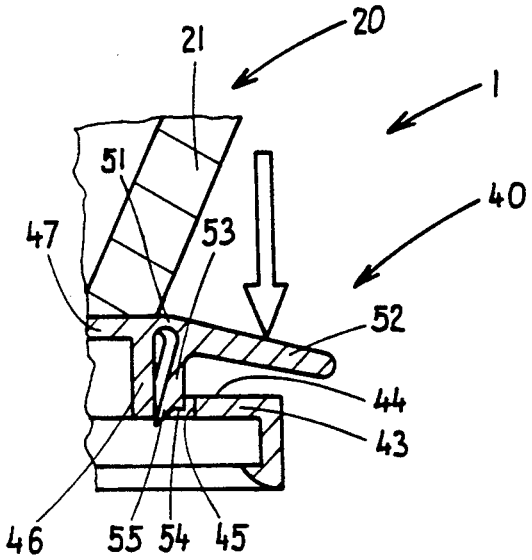
FIG. 4 is an enlarged fragmentary view of the dispensing head at the right side of FIG. 1, showing the actuator member in unlocked position.

Depression of finger tab portion 52 in a direction parallel to the axis defined by stem 15 and toward container 10 as indicated by the arrow in FIG. 4, causes the tilting of it together with the locking tang 53. The finger tab portion 52 is operable between the first locked position (shown in FIG. 1) and a second non-blocking unlocked position (shown in FIG. 4). In the second unlocked position the locking tang 53 abuts the wall 46 and its overlapping surface 54 is disengaged from the upper surface 44 of flange 43, to place the outlet wall portion 47 in a depressible position. Consequently, further depression of the finger tab portion 52 causes the tilting of the outlet wall portion 47 which operates the valve assembly 14 to discharge product from the container 10. After discharging a desired amount of product, pressure is removed from the finger tab portion 52 and the actuator member 40 reassumes its initial locked position.

Although the above described mechanism to lock the actuator member 40 is preferred, presumably other locking means might be utilized to selectively define a first depressible and a second non-depressible position for the outlet wall portion 47.

Figure 3:
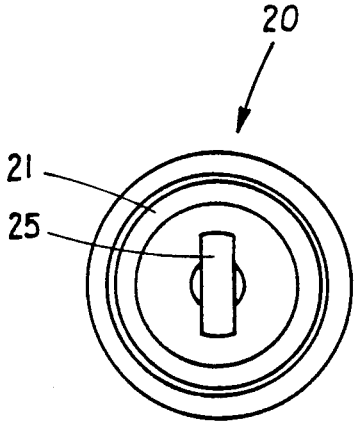
FIG. 3 is a top plan view of the bowl member of the dispensing head of FIG. 1.

Referring again to FIG. 1, the bowl member 20 is attached to the actuator member 40 by suitable means such as adhesive. The bowl member 20 has a continuous wall 21 which forms an upwardly widening frusto-conical tube enclosing a collecting chamber 22 and an overflow chamber 26 therein. The wall 21 defines a terminal end surface 23 and an inlet end surface 24 which is adapted to sealingly engage the outer pressing surface 48 of actuator member 40. The overflow chamber 26 widely opens through the terminal end surface 23. The collecting chamber 22 opens through the inlet end surface 24 and communicates between the discharge orifice 49 and the overflow chamber 26. An obstacle 25 extends horizontally through the collecting chamber 22 above the discharge orifice 49 and is connected to wall 21 at two radially opposite locations as shown in FIG. 3. Obstacle 25 breaks up the stream of the discharging product to prevent it from squirting out from the collecting chamber 22.

When the dispensing head 1 illustrated in FIG. 1 is operated, product is discharged from the container 10 through the stem 15 and the discharge orifice 49 into the collecting chamber 22 where it is deposited. The collecting chamber may be sized so that the desired amount of product to be discharged for one operation fills the volume of the collecting chamber 22. As more product may inadvertently be discharged, the surplus may be accommodated in the overflow chamber 26.

The procedure of applying the discharged product on a skin surface from the collecting chamber 22 comprises the following steps:

abutting the terminal end surface 23 of bowl member 20 on the skin surface;

lightly pressing the container 10 toward the skin surface in a direction normal to the skin surface, thereby squeezing the bowl member 20 to reduce the volumes of both the collecting chamber 22 and the overflow chamber 26 and causing the product to be forced out from the chambers past the terminal end surface 23, to deposit directly onto the skin surface; and moving the container 10 sideways while keeping the terminal end surface 23 abutting on the skin surface to spread the product evenly thereon.

The procedure can be performed easily and conveniently with one hand (preferably with the same one which was used to operate the container 10 for discharging product therefrom).

The steps of pressing the container 10 toward the skin surface and moving it sideways can be performed either successively or simultaneously.

It also will be understood, that the procedure described above will remain the same whether or not the overflow chamber 26 contains product.

Figure 5:
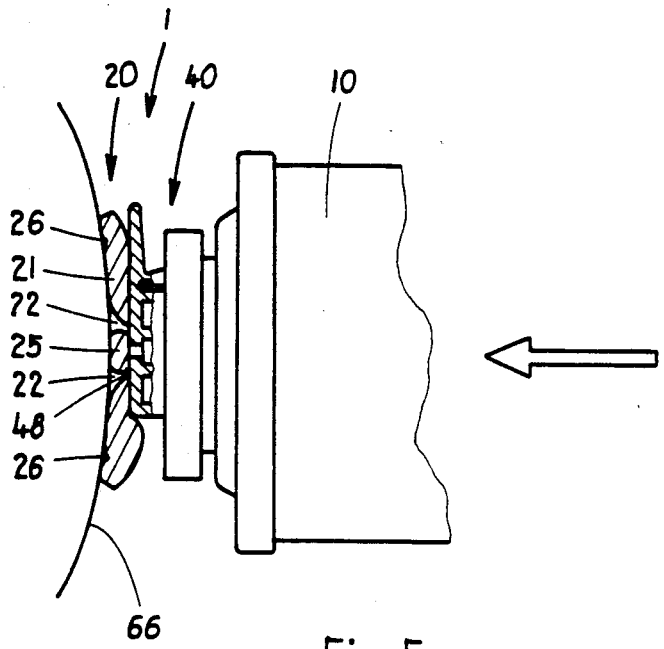
FIG. 5 is a schematic view showing the dispensing head of FIG. 1 pressed against a skin surface.

FIG. 5 illustrates the dispensing head 1 with the bowl member 20 squeezed approximately to its minimum size. The container 10 is pressed axially against a skin surface 66 in a direction normal thereto, as indicated by the arrow. In this manner, the bowl member 20 is axially compressed between the skin surface 66 and the outer pressing surface 48 of actuator member 40. In this case, both the collecting chamber 22 and the overflow chamber 26 are decreased to a negligible volume.

After removing the pressure from the container 10, the bowl member 20 reassumes its initial size and form, as shown in FIG. 1.

After use, the dispensing head 1 can be easily rinsed by water to remove any remaining product from the bowl member 20.

Although the bowl member 20 is squeezable into the position shown in FIG. 5 without overcoming the preload of the compression closing spring of valve assembly 14, the user may inadvertently exceed the preload force in pressing the container 10 toward the skin surface 66. For this reason, the actuator member 40 is safety locked, as described above.

Figure 8:
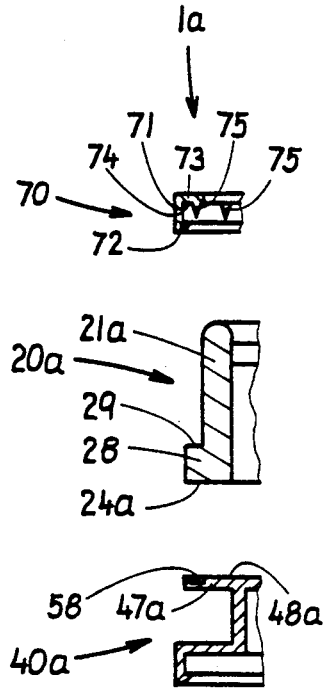
FIG. 8 is a fragmentary view of the members at the left side of FIG. 6 shown prior to assembling.
Figure 6:
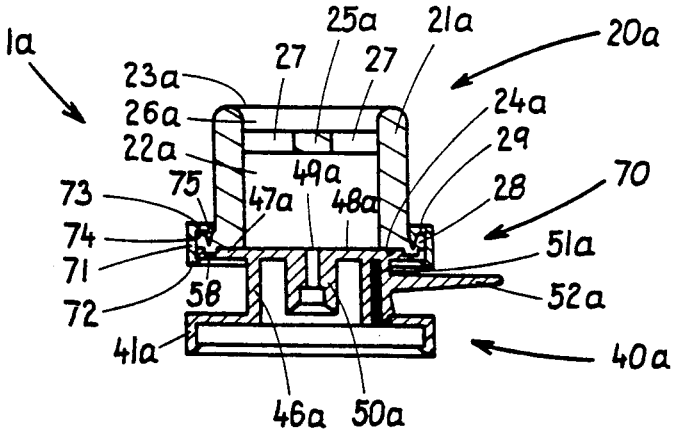
FIG. 6 is an axial sectional view of a first modified embodiment.
Figure 7:
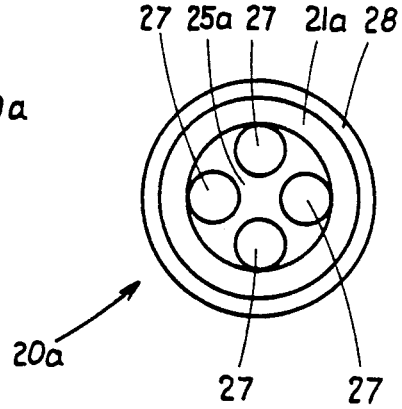
FIG. 7 is a top plan view of the bowl member of the dispensing head of FIG. 6.

A first modified embodiment of the invention is illustrated in FIGS. 6 to 8. In this embodiment, the dispensing head 1*a* comprises an actuator member 40*a*, a bowl member 20*a*, and a clamp ring member 70. The actuator member 40*a* has an enlarged outlet wall portion 47*a* hingedly connected to a ring portion 41*a*. The upper side of the outlet wall portion 47*a* defines an outer pressing surface 48*a* and a groove 58.

A finger tab portion 52*a* is connected to the underside of the outlet wall portion 47*a* by a second hinge 51*a*. A skirt 46*a* and a stem engaging nipple 50*a* are joined to the underside of the outlet wall portion 47*a*. A discharge orifice 49*a* extends through the outlet wall portion 47*a* at its center and communicates with the stem engaging nipple 50*a*. Other features of the actuator member 40*a* are substantially the same as described in the first embodiment in FIGS. 1 to 5.

The bowl member 20*a* has an annular wall 21*a* of which interior is divided into a collecting chamber 22*a* and an overflow chamber 26*a* by a horizontal obstacle wall 25*a*. Obstacle wall 25*a* has four holes 27 therethrough for providing communication between the collecting chamber 22*a* and the overflow chamber 26*a*. The rounded top of the annular wall 21*a* defines a terminal end surface 23*a*. The bottom of the annular wall 21*a* defines an inlet end surface 24*a*. An outwardly extending rim wall 28 is joined to the lower end of annular wall 21*a*. Rim wall 28 defines an upper surface 29 and a lower surface which is generally level with the inlet end surface 24*a*.

The clamp ring member 70 has an annular wall portion 71 of which the inner surface is mated to engage both the rim wall 28 of bowl member 20*a* and the outlet wall portion 47*a* of actuator member 40*a*. An inwardly extending flange 73 is joined to the upper end of annular wall 71 and defines a sealing surface 74 at its underside. A plurality of rigid tapered claws 75 are spaced apart on the sealing surface 74. The lower end of the annular wall 71 has locking means 72 which snappingly engage the underside of outlet wall portion 47*a* of actuator member 40*a*.

It is noted, that the largest radial extension of the dispensing head 1*a*, measured normal to the axis of nipple 50*a*, is substantially less than the radius of the container on which it is to be mounted. Thus, the container can be provided with a conventional cylindrical overcap.

When the dispensing head 1*a* is assembled, the clamp ring member 70 engages the surface 29 of bowl member 20*a* by its sealing surface 74 and the underside of outlet wall portion 47*a* of actuator member 40*a* by its locking means 72, as shown in FIG. 6. The rim wall 28 of bowl member 20*a* is compressed between the sealing surface 74 of clamp ring member 70 and the outer pressing surface 48*a* of actuator member 40*a*. Thereby the inlet end surface 24*a* of bowl member 20*a* sealingly engages the outer pressing surface 48*a* of actuator member 40*a*. The rim wall 28 of bowl member 20*a* is partly pressed into the groove 58, which constitutes an additional seal between the bowl member 20*a* and the actuator member 40*a*. The claws 75 of clamp ring member 70 press into the rim wall 28 of bowl member 20*a* to securely engage it. It is preferred, that the claws 75 are arranged to correspond to groove 58 of actuator member 40*a*.

Figure 9:
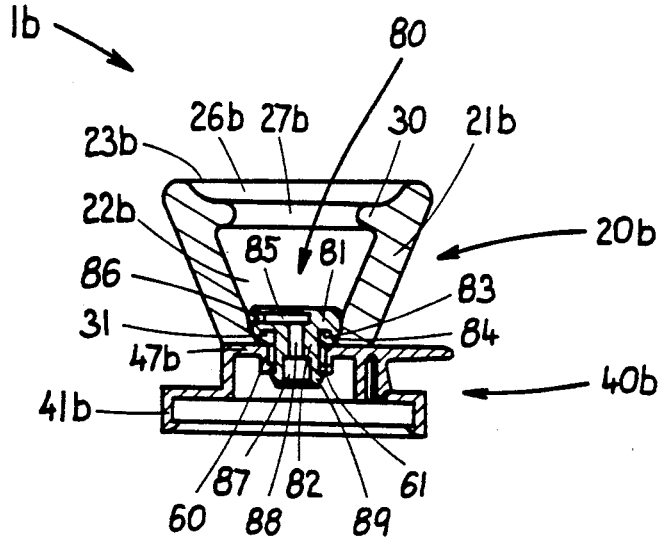
FIG. 9 is an axial sectional view of a second modified embodiment.
Figure 11:
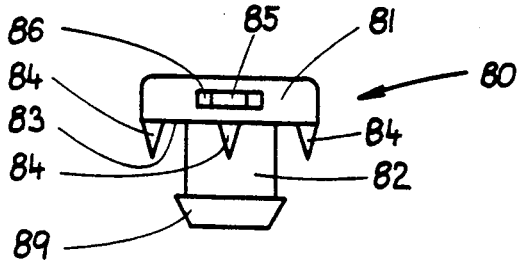
FIG. 11 is an enlarged left side elevation of the actuator member of the second modified embodiment.
Figure 10:
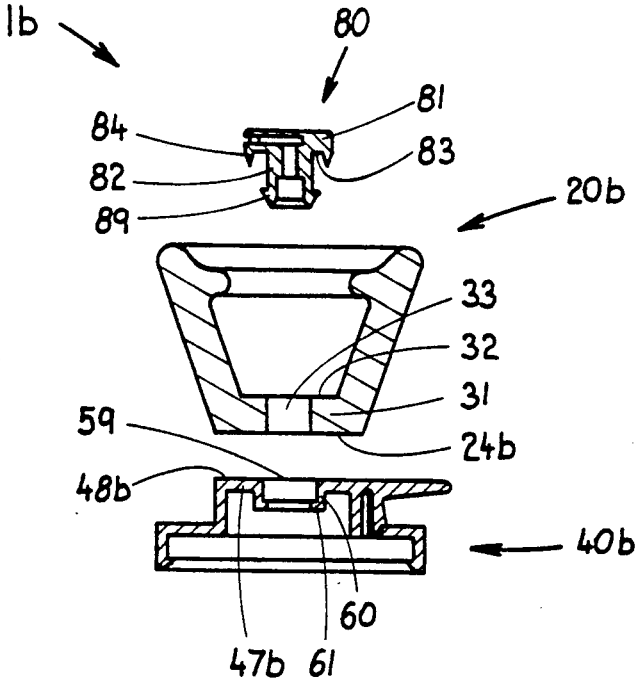
FIG. 10 is an axial sectional view showing the members of the second modified embodiment prior to assembling.

A second modified embodiment of the invention is shown in FIGS. 9 to 11. In this embodiment, the dispensing head 1*b* comprises a mounting member 40*b*, a collector member 20*b*, and a valve actuator member 80. The mounting member 40*b* has an outlet wall portion 47*b* hingedly connected to a ring portion 41*b*. The outlet wall portion 47*b* defines an outer pressing surface 48*b* and a central hole 59 opening therethrough. A depending skirt 60 is joined to the underside of the outer wall portion 47*b* at the edge of central hole 59. The depending skirt 60 has a restricted lower end 61. Other features of the mounting member 40*b* are substantially the same as of the actuator member shown at reference 40 in FIGS. 1 to 5.

The collector member 20*b* has an upwardly widening frusto-conical side wall 21*b* of which interior is divided into a collecting chamber 22*b* and an overflow chamber 26*b* by a horizontal wall 30. Wall 30 has a wide hole 27*b* therethrough for providing communication between the collecting chamber 22*b* and the overflow chamber 26*b*. The rounded top of said wall 21*b* defines a terminal end surface 23*b*. A bottom wall 31 is joined to the lower end of side wall 21*b*. Said bottom wall 31 has an inlet end surface 24*b* at its underside, an engaging surface 32 at its upper side, and a centrally located hole 33 therethrough. The diameter of hole 33 is substantially the same as the inside diameter of the restricted lower end 61 of skirt 60 of mounting member 40*b*.

The valve actuator member 80 has a circular head portion 81 and a centrally located shank portion 82 thereon. The head portion 81 defines a sealing surface 83 at its lower side which is adapted to the engaging surface 32 of collector member 20*b*. A plurality of rigid tapered claws 84 are spaced apart on the sealing surface 83. A discharge orifice 86 extends through the side wall of the head portion 81. A passageway 85 extends radially outwardly from the center of head portion 81 and communicates with the discharge orifice 86. The shank portion 82 has a cylindrical outer surface which is joined to the sealing surface 83 of head portion 81. The cylindrical outer surface of shank portion 82 engages both the centrally located hole 33 of collector member 20*b* and the restricted lower end 61 of skirt 60 of mounting member 40*b*. The shank portion 82 also has locking means 89 which are adapted to snappingly engage the underside of the restricted lower end 61 of skirt 60 of mounting member 40*b*. The lower end of the shank portion 82 forms a stem engaging socket 87. A bore 88 communicates between the socket 87 and said passageway 85.

When the dispensing head 1*b* is assembled, the sealing surface 83 of the valve actuator member 80 engages the engaging surface 32 of the collector member 20*b*. The locking means 89 engage the restricted lower end 61 of skirt 60 of mounting member 40*b* to secure the valve actuator member 80 to the mounting member 40*b*. The lower end 61 of skirt 60 of mounting member 40*b* and locking means 89 of valve actuator member 80 are mated so that after they are interengaged with each other, they are not being disengageable by a manual force.

It is noted, that the depending skirt 60 of mounting member 40*b* or the shank portion 82 of valve actuator member 80 may have longitudinal slits extending from the underside thereof to enable them to yield, when they are being assembled.

The bottom wall 31 of collector member 20*b* is compressed between the sealing surface 83 of valve actuator member 80 and the outer pressing surface 48*b* of mounting member 40*b*. Thereby sealing is provided between the sealing surface 83 of valve actuator member 80 and the engaging surface 32 of collector member 20*b*. Claws 84 of valve actuator member 80 press into the bottom wall 31 of collector member 20*b* for securely retaining it.

In this embodiment the discharge orifice 86 is directed to the side wall 21*b* of collector member 20*b*. Furthermore, its bypass section is larger than the bypass section of passageway 85, which reduces the velocity of the emerging product. Consequently, the product will not squirt out from the collector member 20*b* when it is being discharged, therefore obstacle means such as shown at references 25 and 25*a* in FIGS. 3 and 7 are not required.

It is to be understood that while certain embodiments of the present invention have been illustrated and described herein, it is not intended to limit this specification to those specific forms or arrangements of parts described and shown.

I claim:

1. For use with a pressurized container including a centrally located valve having an orificed valving member, a dispensing head assembly comprising:

(a) a mounting member having a ring portion for attachment to said container at a position radially spaced from and surrounding a vertical axis defined by said valving member, a generally circular outlet wall portion defining a substantially horizontal outer pressing surface at its upper side and an opening therethrough aligned with said vertical axis, a depending skirt portion joined to the lower side of said outlet wall portion at the edge of said opening and having a restricted lower end, a perimetrical skirt portion joined to and extending downward from said outlet wall portion and being connected to said ring portion by a flexible hinge at a first radial position, and a radially outwardly extending finger tab portion hingedly connected to one of said outlet wall portion and said perimetrical skirt portion substantially opposite to said first radial position and having a locking tang rigidly joined to its underside, said finger tab portion being operable between a first locked and a second unlocked position;

(b) an elastically squeezable collector member having a bottom wall portion and continuous side wall means joined to and extending upward from the periphery of said bottom wall portion, said side wall means defining a central axis generally uniaxical with said vertical axis, said side wall means enclosing a collecting chamber therein, the upper end of said side wall means defining a terminal end surface, said terminal end surface having at least one exit opening therethrough in communication with said collecting chamber, said bottom wall portion defining an inlet end surface at its lower side attaching to said outer pressing surface of said mounting member, said bottom wall portion further defining an engaging surface at its upper side and a centrally located hole opening therethrough; and (c) a valve actuator member having a generally circular head portion and a centrally located shank portion thereon, said head portion having a sealing surface at its lower side attaching to said engaging surface of said collector member and a passageway extending radially outward from its center, said passageway terminating in a discharge orifice opening through the side surface of said head portion, said shank portion having a cylindrical outer surface joined to and extending downward from said sealing surface, said cylindrical outer surface engaging both said centrally located hole of said collector member and the inner surface of said restricted lower end of said depending skirt portion of said mounting member, said shank portion further having a surface engaging said valving member, a bore extending through said surface and providing fluid communication between said valving member and said passageway, and locking means for engaging said restricted lower end of said depending skirt portion of said mounting member;

wherein said bottom wall portion of said collector member is squeezed between said sealing surface of said valve actuator member and said outer pressing surface of said mounting member, to effect sealing between said sealing surface of said valve actuator member and said engaging surface of said collector member.

2. A dispensing head as defined in claim 1, wherein the lower end of said tang overlaps said ring portion to block depression of said outlet wall portion when said finger tab portion is in said first locked position, and said tang bears against said perimetrical skirt portion in a non-overlapping relationship with said ring portion when said finger tab portion is in said second unlocked position.

3. A dispensing head as defined in claim 1, wherein said outlet wall portion is detachably connected to said ring portion by a frangible web.

4. A dispensing head as defined in claim 1, wherein the upper end of said side wall means of said collector member further defines an overflow chamber communicating with said collecting chamber and opening through said terminal end surface.

5. A dispensing head as defined in claim 4, wherein said collector member further has a separating wall between said collecting chamber and said overflow chamber, said wall having at least one opening therethrough for providing communication between said collecting chamber and said overflow chamber.

6. A dispensing head as defined in claim 1, wherein said side wall means of said collector member diverges away from said bottom wall portion.

7. A dispensing head as defined in claim 1, wherein said collector member is made of flexible synthetic foam.

* * * * *